US007970294B2

(12) United States Patent
Shin

(10) Patent No.: US 7,970,294 B2
(45) Date of Patent: Jun. 28, 2011

(54) DOCUMENT FEEDING APPARATUS AND METHOD

(75) Inventor: Dae-lim Shin, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 906 days.

(21) Appl. No.: 11/452,943

(22) Filed: Jun. 15, 2006

(65) Prior Publication Data

US 2006/0285858 A1 Dec. 21, 2006

(30) Foreign Application Priority Data

Jun. 16, 2005 (KR) ..... 10-2005-0051813

(51) Int. Cl.
*G03G 15/00* (2006.01)

(52) U.S. Cl. ..... 399/16; 399/21; 399/405; 271/3.15; 271/10.02; 271/182; 271/202; 271/258.03; 271/270

(58) Field of Classification Search ..... 399/16, 399/21, 405; 271/3.15, 10.02, 182, 202, 271/258.03, 270
See application file for complete search history.

(56) References Cited

U.S. PATENT DOCUMENTS

| | | | | |
|---|---|---|---|---|
| 5,395,104 | A | 3/1995 | Harada et al. | |
| 6,397,035 | B2 * | 5/2002 | Kataoka et al. | 399/388 |
| 6,785,508 | B2 | 8/2004 | Jeong | |
| 6,793,216 | B2 * | 9/2004 | Nakamura | 271/188 |
| 2003/0062671 | A1 * | 4/2003 | Yasui et al. | 271/270 |
| 2005/0110818 | A1 * | 5/2005 | Sakakibara et al. | 347/16 |

FOREIGN PATENT DOCUMENTS

| | | |
|---|---|---|
| JP | 62-5269 | 1/1987 |
| JP | 6-219603 | 8/1994 |
| JP | 08-225191 | 9/1996 |
| JP | 9-30684 | 2/1997 |
| JP | 09-136730 | 5/1997 |
| JP | 9-194054 | 7/1997 |
| JP | 09-221249 | 8/1997 |
| JP | 9-288392 | 11/1997 |
| JP | 2000-143036 | 5/2000 |

(Continued)

OTHER PUBLICATIONS

Office Action issued May 25, 2006 by the Korean Intellectual Property Office re: Korean Application No. 2005-51813 (3 pp).

(Continued)

*Primary Examiner* — Daniel J Colilla
*Assistant Examiner* — Andy L Pham
(74) *Attorney, Agent, or Firm* — Staas & Halsey LLP

(57) ABSTRACT

A document feeding apparatus includes a first delivery roller delivering a document sheet discharged from a fixing unit, a second delivery roller discharging the document sheet to a paper delivery tray, a motor driving the second delivery roller, a lever installed at the downstream, or upstream, side of the first delivery roller out of a document sheet transporting pathway, which rotates at a predetermined angle when contacting the document sheet and returns to an original position when not contacting the document sheet, a sensor sensing a rotation time and a returning time of the lever, and a controller determining a double feeding or slipping state of the document sheet based on a signal transferred from the sensor regarding the rotation time and the returning time of the lever, and controlling the driving speed of the motor according to the determination result.

31 Claims, 6 Drawing Sheets

FOREIGN PATENT DOCUMENTS

| | | |
|---|---|---|
| JP | 2000-284556 | 10/2000 |
| JP | 2002-174973 | 6/2002 |
| KR | 1998-037638 | 8/1998 |
| KR | 2003-43137 | 6/2003 |
| KR | 2003-79114 | 10/2003 |
| KR | 10-0415608 | 1/2004 |
| KR | 2004-49460 | 6/2004 |

OTHER PUBLICATIONS

Japanese Office Action issued Oct. 6, 2009 in corresponding Japanese Office Action 2006-167863.

* cited by examiner

DOCUMENT FEEDING APPARATUS AND METHOD

CROSS-REFERENCE TO RELATED APPLICATIONS

This application claims benefit under 35 U.S.C. §119 from Korean Patent Application No. 2005-51813, filed on Jun. 16, 2005, in the Korean Intellectual Property Office, the disclosure of which is incorporated herein by reference.

BACKGROUND OF THE INVENTION

1. Field of the Invention

Aspects of the present invention relate in general to a document feeding apparatus and method, and more specifically, to a document feeding apparatus and method for resolving a jam caused by double feeding or slipping in the document transporting pathway.

2. Description of the Related Art

In general, an electrophotographic image forming apparatus, such as a laser beam printer, forms an electrostatic latent image on a photosensitive medium as, for example, a photoconductive body or a photosensitive belt, develops the image with a developer of a predetermined color, and transfers the developed image onto a recording medium to provide a user with a visible image.

In such image forming apparatus, the surface of the photosensitive medium, such as a photoconductive body or a photosensitive belt, is electrically charged through discharge of a charging roller. The charged photosensitive medium is then exposed to a pattern given by laser beams that are emitted from a laser scanning unit, and through this a desired electrostatic latent image is formed on the photosensitive medium. Then the electrostatic latent image formed on the surface of the photosensitive medium comes in contact with a developing roller, and is developed by a toner during rotation of the developing roller for forming a visible image.

A document sheet stacked on a document supply portion is then fed towards a sheet feeding roller by a pick-up roller. Later, the document sheet is carried towards a transfer roller by the rotation of the sheet feeding roller. Here, the toner image formed on the photosensitive medium is transferred onto the document sheet through the pressurization of the transfer roller. The toner image on the document sheet is pressed and heated by a fixing roller, and transported eventually to a discharge tray by the rotation of a delivery roller. In this manner, a print image is obtained.

As described above, the document sheet passes through a plurality of rollers before it is actually released from the image forming apparatus. As a result, paper jams can occur caused by double feeding or slipping of the document sheets in the shortened document transporting pathway.

Various systems and apparatus have been proposed to resolve paper jams. For example, Japanese Patent Application Publication No. 8-225191 discloses a paper jam detection system. Also, Japanese Patent Application Publication No. 8-225191 discloses a sheet conveying device, in which a sensor is installed between rollers, namely between a paper feeding roller and a photoconductive drum, for detecting an abnormal condition in conveyance of a sheet on the basis of a comparison result between an expected passing time of the sheet and an actual passing time.

SUMMARY OF THE INVENTION

It is, therefore, an aspect of the present invention to provide a document feeding apparatus for effectively controlling the rotation speed of a feeding roller according to a sensing result of double feeding or slipping of a document sheet.

Another aspect of the present invention is to provide a document feeding method for controlling a document feeding process.

To achieve the above and/or other aspects of the present invention, there is provided a document discharging apparatus, including: a first delivery roller delivering a document sheet discharged from a fixing unit; a second delivery roller discharging the document sheet to a paper delivery tray; a motor for driving the second delivery roller; a contact sensing member, such as a lever, installed at the downstream, or upstream, side of the first delivery roller adjacent to or out of a document sheet transporting pathway, with the lever rotating through or at a predetermined angle when contacting the document sheet and returning to an initial or original position when contact with the document sheet is absent; a sensor sensing a rotation time and a returning time of the lever; and a controller determining the presence of a double feeding or slipping state of the document sheet based on a signal transferred from the sensor regarding the rotation time and the returning time of the lever, with the controller selectively controlling the driving speed of the motor according to a result of the determination of the presence or absence of the double feeding or slipping state of the document sheet.

In the document discharging apparatus, the lever includes: a contact bar selectively contacting the document sheet; a sensing bar disposed in corresponding relation to the sensor; a rotation axis member, the rotation axis member being installed at a connecting portion between the contact bar and the sensing bar supporting the rotation of the lever; and an elastic unit returning the contact bar and the sensing bar of the lever to an initial or original position when the document sheet is out of contact range of the contact bar, the elastic unit can include a coil spring.

Further, in the document discharging apparatus, the controller determines or memorizes a document sheet entry time when the front end of the document sheet comes in contact with the contact bar of the lever and a document sheet exit time when the rear end of the document sheet is completely out of the contact range of the contact bar of the lever; compares a time difference between the document sheet entry time and the document sheet exit time with a value of the length of the document sheet divided by a process rate, the process rate being a document feeding or transport speed that is a predetermined value, such as the default value of the document feeding or transport speed, in the document discharging apparatus; and the controller controls the rotation speed of the second delivery roller to maintain the rotation speed of the second delivery roller at a predetermined speed, when the time difference between the document sheet entry time and the document sheet exit time is different from the value of length of the document sheet divided by the process rate, and the controller reduces the rotation speed of the second delivery roller from the predetermined speed, when the time difference between the document sheet entry time and the document sheet exit time equals to the value of length of the document sheet divided by the process rate.

In the document discharging apparatus, the sensor can be an optical sensor. Also, the sensor and contact sensing member can be combined or integral with each other, as previously described. Further, the motor can be a step motor.

Another aspect of the present invention provides a document feeding apparatus, including: a first feeding roller feeding a document sheet; a second feeding roller installed upstream of the first feeding roller; a motor driving the second feeding roller; a contact sensing member, such as a lever, installed at the downstream, or upstream, side of the first feeding roller adjacent to or out of a document sheet transporting pathway, with the lever rotating through or at a predetermined angle when contacting with the document sheet and returning to an original or initial position when contact with the document sheet is absent; a sensor sensing a rotation time and a returning time of the lever; and a controller determining the presence of a double feeding or slipping state of the document sheet based on a signal transferred from the sensor regarding the rotation time and the returning time of the contact sensing member, such as a lever, and with the controller outputting to the motor a command for selectively changing the driving speed of the motor according to a result of the determination of the presence or absence of the double feeding or slipping state of the document sheet.

In the document feeding apparatus, the lever, includes: a contact bar selectively contacting the document sheet; a sensing bar disposed in corresponding relation to the sensor; a rotation axis member, the rotation axis member being installed at a connecting portion between the contact bar and the sensing bar supporting the rotation of the lever; and an elastic unit returning the contact bar and the sensing bar of the lever to an original or initial position when the document sheet is out of contact range of the contact bar. Also, the elastic unit can include a coil spring.

Further, in the document feeding apparatus, the controller determines or memorizes a document sheet entry time when the front end of the document sheet comes in contact with the contact bar of the lever, and a document sheet exit time when the rear end of the document sheet is completely out of the contact range of the contact bar of the lever; compares a time difference between the document sheet entry time and the document sheet exit time with a value of the length of the document sheet divided by a process rate, the process rate being a document feeding or transport speed that is a predetermined value, such as the default value of the document feeding or transport speed, in the document feeding apparatus; and controls the rotation speed of the second feeding roller to increase the rotation speed of the second delivery roller when the time difference between the document sheet entry time and the document sheet exit time is different from the value of length of the document sheet divided by the process rate.

In the document feeding apparatus, the sensor can be an optical sensor, and the motor can be a step motor.

A further aspect of the present invention provides a document discharging method, including: sensing a time when a contact sensing member, such as a lever, contacts the front end of a document sheet that is to enter into, or engage, a first delivery roller, the lever being pushed upwardly, or downwardly, by the front end of a document sheet that is to enter into, or engage the first delivery roller; sensing a time when the lever returns to an initial or original position after the rear end of the document sheet is completely out of a contact range of the lever; determining or memorizing the time when the lever comes in contact with the front end of the document sheet and the time when the rear end of the document sheet is out of the contact range of the lever, comparing a time difference of the time when the front end of the document sheet contacts the lever and the time when the rear end of the document sheet is out of contact range of the lever with a reference value to provide a comparison result, and determining a double feeding or slipping state of the document sheet based on the comparison result; and in the step for determining a double feeding or slipping state, when the double feeding or slipping of the document sheet occurs, rotating a second delivery roller discharging the document sheet to a paper delivery tray at a constant predetermined discharge speed, and when the document sheet is fed without the double feeding or slipping, reducing the discharge speed of the second delivery roller from the predetermined discharge speed.

The document discharging method further comprises restoring the discharge speed of the second delivery roller, when the document sheet is fed properly.

In the document discharging method in determining the double feeding or slipping state, the time when the lever comes in contact with the front end of the document sheet and the time when the rear end of the document sheet is out of the contact range of the lever are determined or memorized; and when a time difference of the time when the lever comes in contact with the front end of the document sheet and the time when the rear end of the document sheet is out of the contact range of the lever is equal to a value of length of the document sheet divided by process rate, the document sheet is discharged without being in the double feeding or slipping state, whereas when the time difference of the time when the lever comes in contact with the front end of the document sheet and the time when the rear end of the document sheet is out of the contact range of the lever is different from the value of length of the document sheet divided by the process rate, the document sheet is in the double feeding or slipping state, the process rate being a document feeding or transport speed that is a predetermined value, such as the default value of the document feeding or transport speed.

Another aspect of the present invention provides a document feeding method, including: sensing a time when a contact sensing member, such as a lever, contacts the front end of a document sheet that is to enter into, or engage, a first feeding roller, the lever being pushed upwardly, or downwardly, by the front end of a document sheet that is to enter into, or engage, the first feeding roller; sensing a time when the lever returns to an initial or original position after the rear end of the document sheet is completely out of a contact range of the lever; determining or memorizing the time when the lever comes in contact with the front end of the document sheet and the time when the rear end of the document sheet is out of the contact range of the lever, comparing a time difference of the time when the front end of the document sheet contacts the lever and the time when the rear end of the document sheet is out of contact range of the lever with a reference value to provide a comparison result, and determining a double feeding or slipping state of the document sheet based on the comparison result; and when the double feeding or slipping of the document sheet occurs, outputting a command to change a driving or rotation speed of the second feeding roller, and when the document sheet is fed without the double feeding or slipping, maintaining the driving or rotation speed of the second feeding roller.

In the document feeding method, in determining the double feeding or slipping state, the time when the lever comes in contact with the front end of the document sheet and the time when the rear end of the document sheet is out of the contact range of the lever are determined or memorized; and when a time difference of the time when the lever comes in contact with the front end of the document sheet and the time when the rear end of the document sheet is out of the contact range of the lever is equal to a value of length of the document sheet divided by a process rate, the document sheet is fed without being in the double feeding or slipping state, whereas when the time difference of the time when the lever comes in contact with the front end of the document sheet and the time when the rear end of the document sheet is out of the contact range of the lever is different from the value of length of the document sheet divided by the process rate, the document sheet is in the double feeding or slipping state, the process rate being a document feeding or transport speed that is a predetermined value, such as the default value of the document feeding or transport speed.

Also, in the document feeding method, when the double feeding or slippage of the document sheet occurs, the driving or rotation speed of the second feeding roller is increased for a predetermined amount of time.

Additional aspects and/or advantages of the invention will be set forth in part in the description which follows and, in part, will be obvious from the description, or may be learned by practice of the invention.

Therefore, the document feeding and discharging apparatus and methods of the present invention can be advantageously used for reducing paper jams by effectively securing the interval between document sheets at the occurrence of double feeding or slippage of sheets.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE EMBODIMENTS

Figure 1:
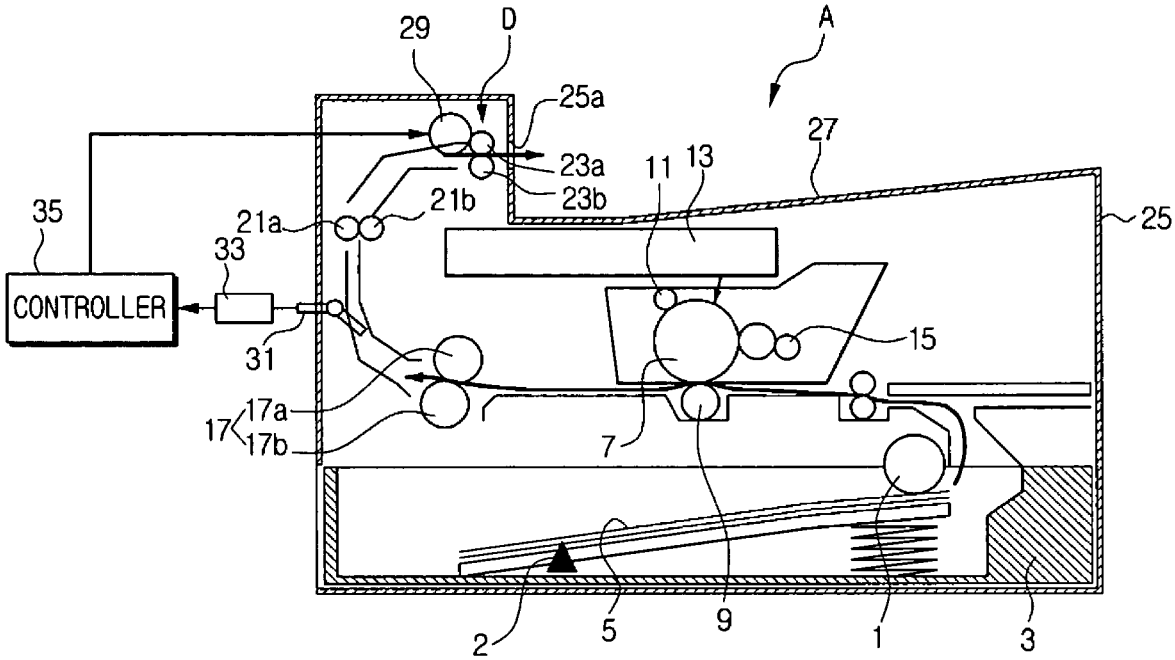
FIG. 1 is a schematic view illustrating a configuration of an image forming apparatus including a document discharging apparatus and a document feeding apparatus according to an embodiment of the present invention.

Reference will now be made in detail to the present embodiments of the present invention, examples of which are illustrated in the accompanying drawings, wherein like reference numerals refer to the like elements throughout. The embodiments are described below in order to explain the present invention by referring to the figures.

FIG. 1 is a schematic view illustrating the configuration of an image forming apparatus A including a document discharging apparatus D and a document feeding apparatus F according to an embodiment of the present invention.

Referring to FIG. 1, when a print command is issued, a pick-up roller 1 starts rotating, and document sheets 5 stacked on a paper cassette 3 are provided one by one between a photosensitive medium, such as a photoconductive body 7, and a transfer roller 9. The document sheet 5, as a sheet member, in addition to being of a paper medium, can be of any suitable medium, such as a film or plastic type medium.

At the same time, the surface of the photoconductive body 7 is charged by discharge of a charging roller 11. The surface of the charged photoconductive body 7 is then exposed to a pattern given by laser beams L that are emitted from a laser scanning unit 13, and through this a desired electrostatic latent image is formed on the photoconductive body. Later, a developing roller 15 adjacent to the surface of the photoconductive body 7 is rotated and a toner image is formed through a portion of the surface where the electrostatic latent image is formed. Then the transfer roller 9 presses the photoconductive body 7 and while rotating, it transfers the toner image formed on the photoconductive body 7 onto the document sheet 5.

The document sheet 5 is conveyed further to a fixing unit 17, and passes between a heating roller 17*a* and a pressing roller 17*b* of the fixing unit 17. Here, the document sheet 5 is heated and pressed at a predetermined temperature and pressure, and a powder toner image is fixed thereon.

The document sheet 5 bearing the toner image is carried through the rotational force of a first delivery roller 21*a* and a first delivery idle roller 21*b*, passes between a second delivery roller 23*a* and a second delivery idle roller 23*b*, and is eventually discharged through a paper discharge opening 25*a* to a paper delivery tray 27 disposed at the outside of an apparatus main body 25.

If the document sheet 5 is fed properly, the rotation speed of the second delivery roller 23*a* is decreased at the moment when the document sheet 5 is discharged to the paper delivery tray 27, thereby preventing the document sheet 5 from flying off of the tray. On the other hand, if double feeding or slippage occurs, the rotation speed of the second delivery roller 23*a* remains constant.

Figure 2:
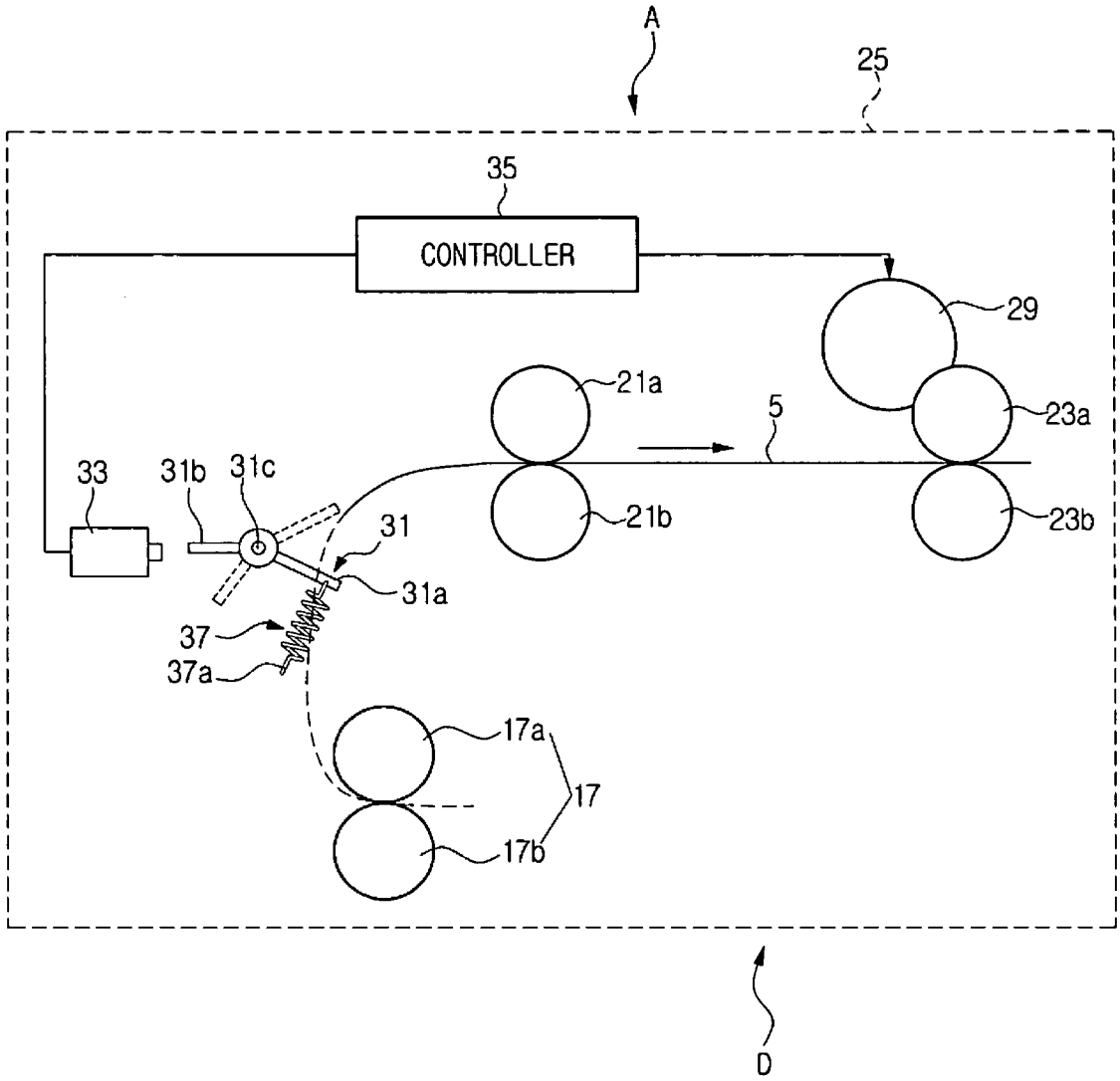
FIG. 2 is a diagram illustrating a configuration of a jam prevention system in an image forming apparatus according to an embodiment of the present invention.

FIG. 2 is a diagram illustrating the configuration of a jam prevention system in the image forming apparatus A including the document discharging apparatus D applied to an embodiment of the present invention. The following explanation, with reference to FIGS. 1 and 2, describes apparatus and methods for preventing a paper jam, such as can be caused by double feeding or slipping state for the document sheets 5, by controlling the rotation speed of the second delivery roller 23*a*.

Referring to FIG. 2, the jam prevention system in the document discharging apparatus D involves the fixing unit 17, the first delivery roller 21*a*, the first delivery idle roller 21*b*, the second delivery roller 23*a*, the second delivery idle roller 23*b*, and a motor 29 coupled to the second delivery roller 23*a*. Downstream of the first delivery roller 21*a* and the first delivery idle roller 21*b*, the document sheet 5 passes through a contact sensing member, such as a lever 31, which is pushed upwardly (or, in other embodiments, moved or pushed downwardly, in view of the direction of travel of the document sheet 5) and rotates at or through a predetermined angle by a contact with the front end of the document sheet 5 and which returns to its initial position after no further contact is made by the lever 31 with the document sheet 5. Moreover, the jam prevention system in the document discharging apparatus D further includes a sensor 33 sensing a rotation time of the lever 31 rotating at or through the predetermined angle and a returning time of the lever 31 to its initial position; and a controller 35, such as a microprocessor or an application specific integrated circuit (ASIC), with associated memory and software or programming, providing a determination result determining a double feeding or slippage of the document sheet 5 based on a signal of the sensor 33 regarding the rotation time and returning time of the lever 31, and the controller 35 controlling the driving speed of the motor 29 based on the determination result.

The lever 31 includes a contact bar 31*a* contacting with the document sheet 5, a sensing bar 31*b* facing the sensor 33, a rotation axis member 31*c* installed at the connecting portion between the contact bar 31*a* and the sensing bar 31*b* supporting the rotation of the lever 31, and an elastic unit 37 returning the lever 31 to its initial position when the document sheet 5 is no longer contacted to the contact bar 31*a*. The elastic unit 37 can be an elastic member or arrangement that provides a biasing force or movement to return the contact sensing member, such as the contact bar 31*a* and sensing bar 31*b* of the lever 31, to the initial position, and the elastic unit can include a resilient member. Here, in the image forming apparatus A, the elastic unit 37 is formed of a coil spring 37*a*. Also, the contact sensing member can be any of an optical, electro-optical, electro-mechanical or mechanical device or apparatus which senses the presence of a sheet member, such as a document sheet, in a sheet member transporting pathway of the apparatus, and senses the absence of the sheet member in the sheet member transporting pathway. Further, the sensor and contact sensing member can be combined or integral with each other.

The controller 35 determines or memorizes a document sheet entry time when the front end of the document sheet 5 comes in contact with the contact bar 31 a of the lever 31, and a document sheet exit time when the rear end of the document sheet 5 is completely out of contact with, or out of the contact range of, the contact bar 31*a* of the lever 31. Later, the controller 35 compares a time difference between these entry and exit times with a value of a length of the document sheet 5 divided by the process rate (document sheet 5/process rate). When the time difference is different from the value of the length of the document sheet 5 divided by the process rate, the controller 35 controls the second delivery roller 23*a* to maintain its rotation speed. On the other hand, when the time difference equals to the value of length of the document sheet 5 divided by the process rate, the controller 35 outputs a command for reducing the rotation speed of the second delivery roller 23*a*. In the document discharging apparatus D, the process rate indicates a document feeding or transport speed that is a predetermined value, such as the default value of the document feeding or transport speed, in the image forming apparatus A. Also, the length of the document sheet 5 can be obtained by a document sheet sensor 2 installed at the paper cassette 3.

Meanwhile, diverse kinds of sensors may be employed as the sensor 33. The sensor 33 can be any of a mechanical, electrical, optical or electro-optical device, apparatus, or system that senses the presence or absence of a sheet member, such as by sensing the rotation time and the returning time of the lever 31, or by sensing from the contact sensing member an entry time when a front end of the sheet member is sensed by the contact sensing member in the sheet member transporting pathway and an exit time when a rear end of the sheet member is sensed by the contact sensing member in the sheet member transporting pathway, and that provides a signal to the controller 35 regarding the rotation time and the returning time of the contact sensing member, or that provides a signal regarding the entry time when a front end of the sheet member is sensed by the contact sensing member in the sheet member transporting pathway and the exit time when a rear end of the sheet member is sensed by the contact sensing member in the sheet member transporting pathway, or that provides a signal regarding sensing the presence or absence of a sheet member, such as a document sheet 5, in a sheet member transport pathway,. Also, the sensor and contact sensing member can be combined or integral with each other, as previously described. An optical sensor equipped with a light receiving element and a light emitting element is one example of a sensor 33. For instance, in such an optical sensor as the sensor 33, it is determined whether a light from the light emitting element of the sensor 33 is reflected to the light receiving element of the sensor 33. In detail, when the sensing bar 31*b* is disposed in corresponding relation to the sensor 33 (at a position where no contact is made between the sensing bar 31*b* and the document sheet 5), a light from the light emitting element of the sensor 33 collides with, or impinges upon, the sensing bar 31*b* and is reflected toward and incident on the light receiving element of the sensor 33. However, when the contact bar 31 a is in contact with the document sheet 5 and is rotated in consequence at or through the predetermined angle, the light from the light emitting element of the sensor 33 is not reflected towards the light receiving element of the sensor 33. Therefore, the optical sensor as the sensor 33 can detect when the document sheet 5 comes in and when the document sheet 5 is completely gone.

Lastly, the motor 29 can be any motor or motive device that can maintain or vary the rotation speed of the second delivery roller, such as variable speed motor or a step motor capable of changing its driving speed instantaneously.

Figure 3A:
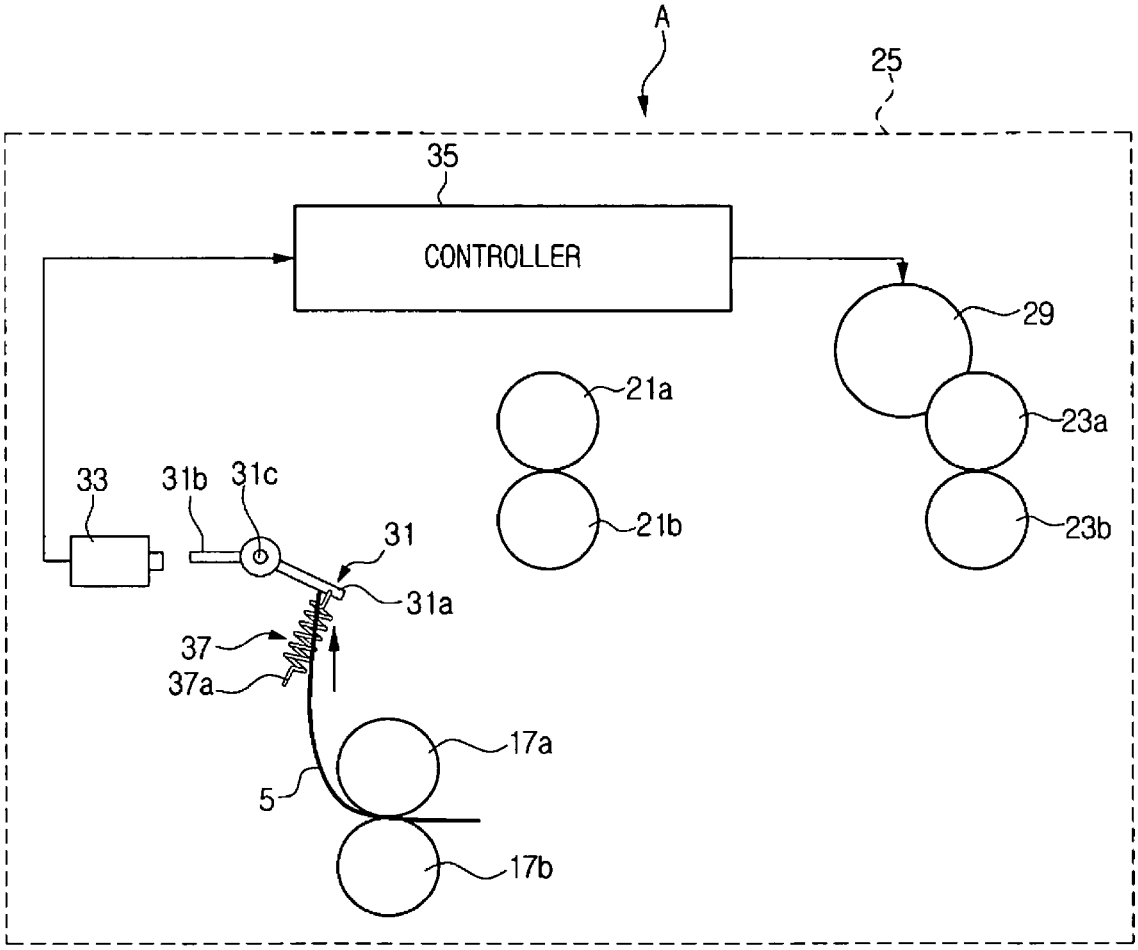
FIG. 3A diagrammatically illustrates in an image forming apparatus a double feeding or slipping state where plural document sheets are fed into contact with a contact sensing member of an image forming apparatus according to an embodiment of the present invention.
Figure 3B:
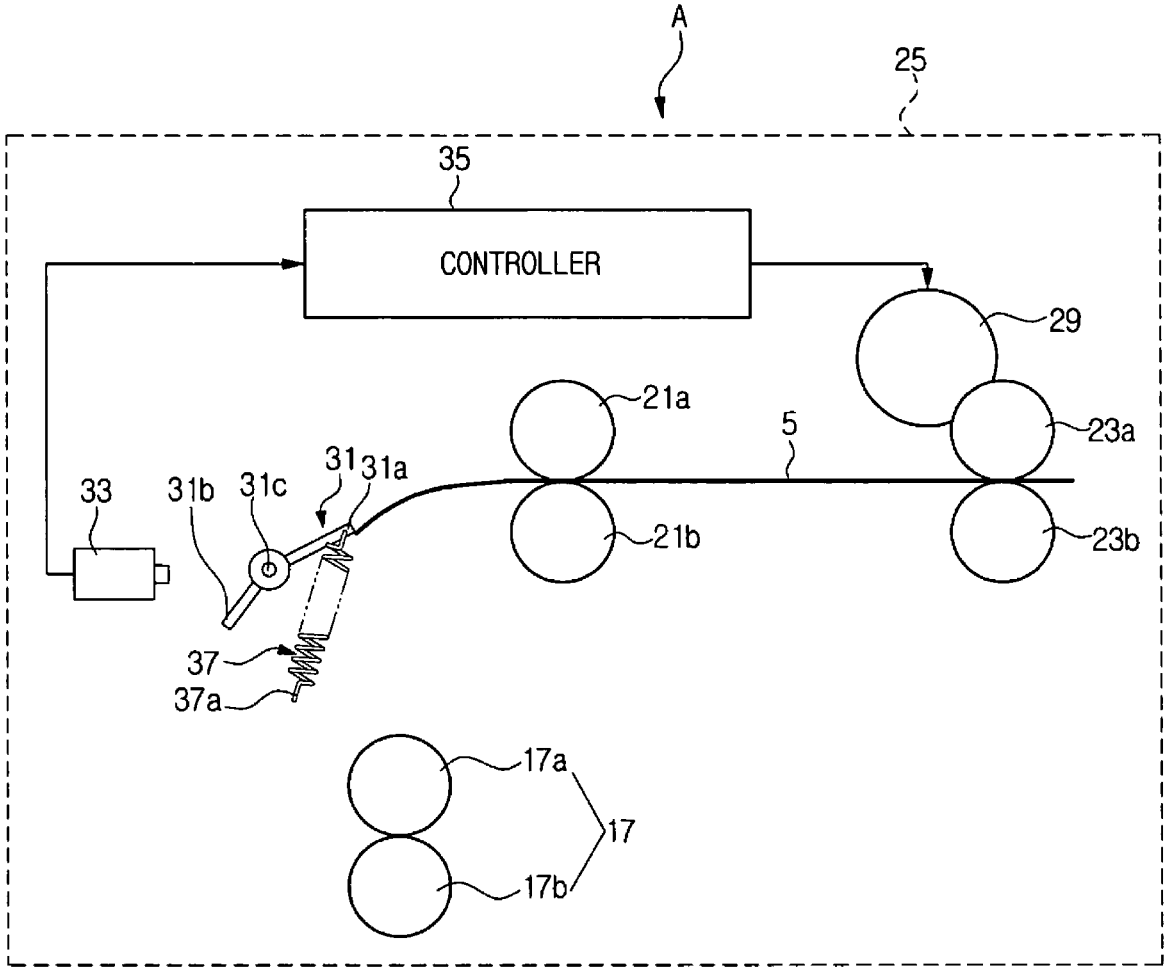
FIG. 3B diagrammatically illustrates in an image forming apparatus a state where plural document sheets in a double feeding or slipping state are moving out of contact with a contact sensing member of an image forming apparatus according to an embodiment of the present invention.
Figure 4:
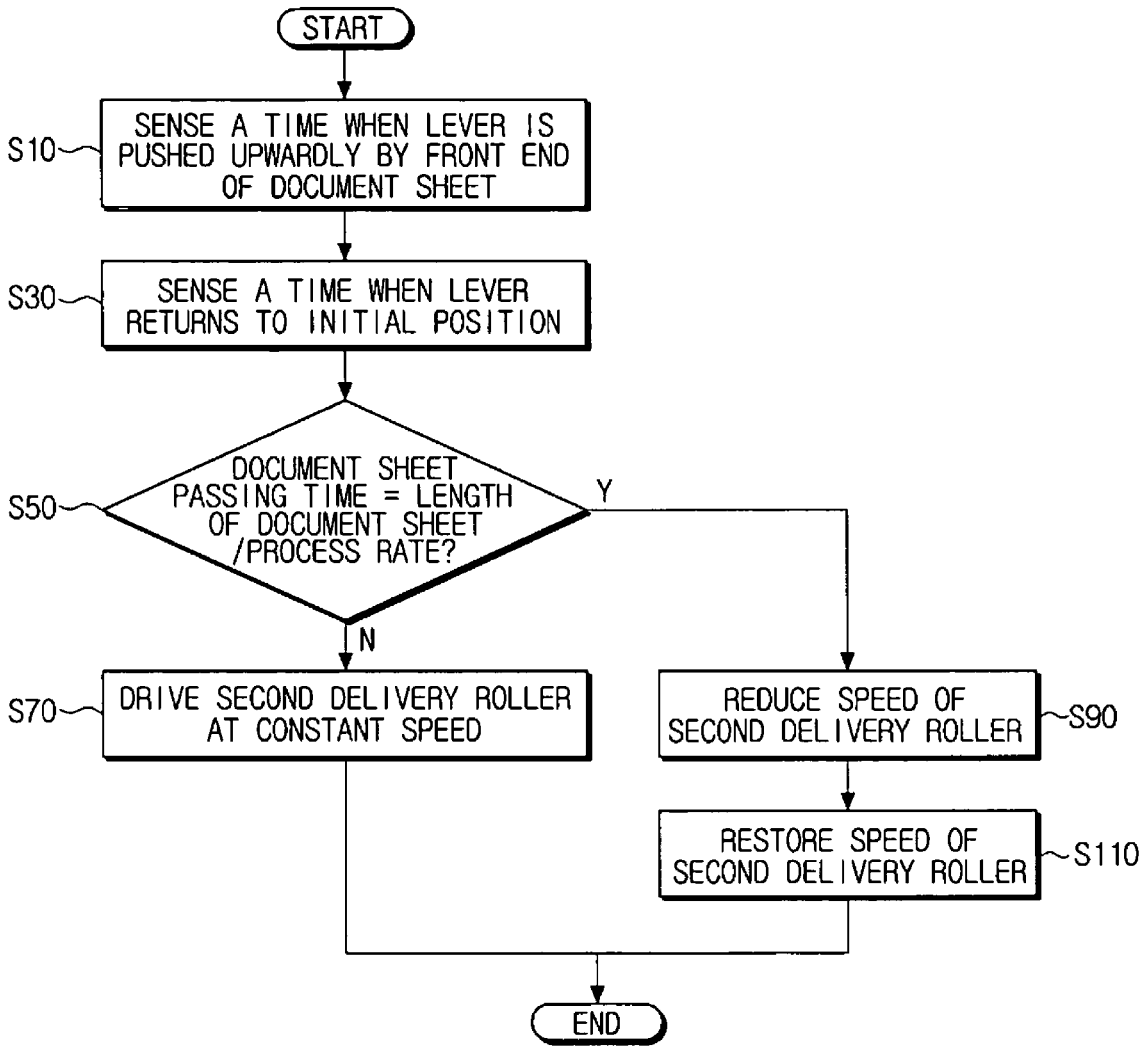
FIG. 4 is a flow chart explaining a jam prevention method for an image forming apparatus according to an embodiment of the present invention.

With reference to FIGS. 3A, 3B and 4, a document discharging method in an embodiment of the present invention will now be described using the image forming apparatus A of FIGS. 1 and 2. In this regard, FIG. 3A illustrates a double feeding state where plural document sheets 5 are fed into contact with the lever 31; FIG. 3B illustrates a state where document sheets 5 in a double feeding state are getting out of contact with the lever 31; and FIG. 4 is a flow chart explaining a jam prevention method relating to a document discharging method according to an embodiment of the present invention.

Referring to FIGS. 3A, 3B and 4, the document sheet 5 discharged through the fixing unit 17 keeps following its transporting pathway, and when it comes near the lever 31, the front end of the document sheet 5 pushes the contact bar 31 a of the lever 31 upwardly. In consequence, the lever 31 starts rotating with respect to the rotation axis member 31*c*, and the sensing bar 31*b* moves away from, or out of corresponding relation with, the sensor 33. The sensor 33 senses this point in time (the document sheet entry time) (operation S10) and transfers a signal to the controller 35.

In the course of the transportation of the document sheet 5 in the image forming apparatus A, the contact bar 31*a* keeps rotating for a predetermined amount of time, or at or through a predetermined angle, as long as it is in contact with the document sheet 5. However, when the rear end of the document sheet 5 is completely out of contact with, or out of the contact range of, the contact bar 31*a*, the lever 31 rotates to return to its original or initial position. The sensing bar 31*b*, too, returns to its original or initial position, facing in corresponding relation to the sensor 33 again. Then, the sensor 33 senses this point in time (the document sheet exit time) (operation S30), and transfers a signal to the controller 35.

In this manner, the controller 35 which determines or memorizes the document sheet entry time and the document sheet exit time can determine or calculate a passing time of the document sheet 5, and compares whether the document sheet passing time equals to the value of length of the document sheet 5 divided by the process rate (operation S50) the process rate indicating a document feeding or transport speed that is a predetermined value, such as the default value of the document feeding or transport speed, in the image forming apparatus A. As aforementioned, the length of the document sheet 5 can be obtained by the document sheet sensor 2 installed in the paper cassette 3.

As can be seen in FIGS. 3A and 3B, when double feeding or slippage occurs of the document sheets 5, the document sheet passing time is greater than the value of length of the document sheet 5 divided by the process rate. In this case, the controller 35 commands the motor 29 not to change its driving speed from a predetermined value, so that the rotation speed of the second delivery roller 23*a* remains constant at a predetermined discharge or rotation speed (operation S70). In this manner, the document sheet 5 can be discharged speedily and the interval between document sheets 5 is secured, resultantly promoting prevention of the occurrence of a paper jam.

On the other hand, when in operation S50 the document passing time is equal to the value of length of the document sheet 5 divided by the process rate, the controller 35 commands the motor 29 to reduce its driving speed from the predetermined value, so that the rotation speed of the second delivery roller 23*a* is reduced from the predetermined discharge or rotation speed (operation S90). The driving speed of the motor 29 is then reduced for a predetermined amount of time from the document sheet exit time (i.e., the time when the rear end of the document sheet 5 is completely out of contact with, or out of the contact range of, the contact bar 31*a*) and is discharged to the paper delivery tray 27 through the paper discharge opening 25*a*. Thus, the motor 29 controlled by the controller 35, promotes ensuring that the document sheet 5 does not fly off of the paper delivery tray 27.

The driving speed of the motor 29 is restored to its normal speed, the predetermined value of the driving speed, after the lapse of the predetermined amount of time and as a result, the rotation speed of the second delivery roller 23*a* is also restored to its normal speed, the predetermined discharge or rotation speed (operation S110).

The same principles, and jam prevention methods, as previously described, can be applied to a case where a document sheet 5 is slipped at the fixing unit 17 and the first delivery roller 21*a*, for example. When slippage occurs, the document sheet 5 does not arrive in the right place at the right time in the image forming apparatus A, so the interval between document sheets 5 is reduced. Similar to the double feeding, there is a high possibility that paper jams can occur frequently when the rotation speed of the second delivery roller 23*a* is reduced. Therefore, application of the above jam prevention methods of the present invention where a document sheet 5 is slipped at the fixing unit 17 and the first delivery roller 21*a* can promote reducing the possibility of such paper jams.

Figure 5:
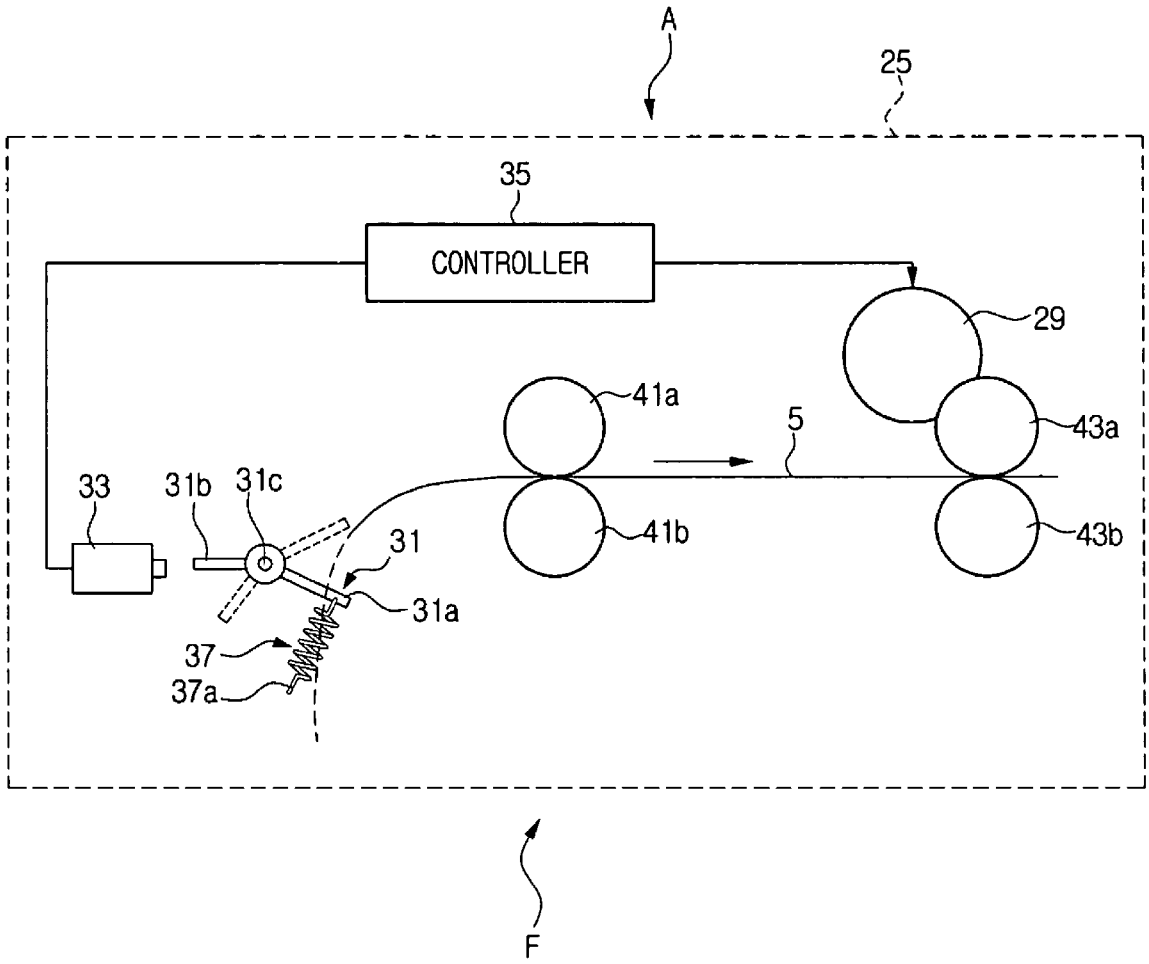
FIG. 5 is a diagram illustrating the configuration of a jam prevention system in an image forming apparatus including a document feeding apparatus according to an embodiment of the present invention.

Further, referring to FIG. 5, the application of the present invention is not limited to the first and second delivery rollers 21*a*, 23*a* discharging the document sheet 5. In this regard, the present invention can also be applied to jam prevention methods in relation to feeding apparatus and feeding methods for other types of rollers or sheet feeding rollers in other embodiments of the present invention, such as sheet feeding rollers 41*a*, 41*b*, 43*a*, 43*b* of FIG. 5. The same components as those previously discussed in relation to FIGS. 1 through 3B, or like components, are designated by the same reference numerals and, therefore, the explanation of those components, when the same or similar, will be omitted hereafter in relation to the discussion of FIG. 5.

Referring to FIG. 5, a document feeding apparatus F in an embodiment of the present invention is illustrated. The document feeding apparatus F includes the first feeding roller 41*a* and the first feeding idle roller 41*b* feeding a document sheet 5, and the second feeding roller 43*a* and the second feeding idle roller 43*b*, installed upstream of the first feeding roller 41*a* and the first feeding idle roller 41*b*. The document feeding apparatus F also includes the motor 29 driving the second feeding roller 43*a*, and a contact sensing member, such as the lever 31. The lever 31 is installed at the downstream side of the second feeding roller 43*a* adjacent to or out of a document sheet transporting pathway, as illustrated in FIG. 5. The lever 31 rotates at or through a predetermined angle when contacting with the document sheet 5 and returns to an original or initial position when contact with the document sheet 5 is absent, as illustrated in FIG. 5. The sensor 33 senses a rotation time and a returning time of the lever 31.

The document feeding apparatus F includes the controller 35 determining the presence of a double feeding or slipping state of the document sheet based on a signal transferred from the sensor 33 regarding the rotation time and the returning time of the lever 31. The controller 35 outputs to the motor 29 a command selectively changing the driving speed of the motor 29 according to a result of the determination of the presence or absence of the double feeding or slipping state of the document sheet 5.

Further, continuing with reference to FIG. 5, in the document feeding apparatus F, the controller 35, such as a microprocessor or an application specific integrated circuit (ASIC), with associated memory and software or programming, determines or memorizes a document sheet entry time when the front end of the document sheet 5 comes in contact with the contact bar 31*a* of the lever 31 and a document sheet exit time when the rear end of the document sheet 5 is completely out of the contact range of the contact bar 31*a* of the lever 31; compares a time difference between the document sheet entry time and the document sheet exit time with a value of the length of the document sheet 5 divided by a process rate, the process rate being a document feeding or transport speed that is a predetermined value, such as the default value of the document feeding or transport speed; and the controller 35 controls the rotation speed of the second feeding roller 43*a* to increase the rotation speed of the second feeding roller 43*a*, when the time difference between the document sheet entry time and the document sheet exit time is different from the value of length of the document sheet 5 divided by the process rate.

Also, with regard to the document feeding apparatus F illustrated in FIG. 5, a document feeding method in an embodiment of the present invention includes sensing a time when the contact bar 31*a* of the lever 31 contacts the front end of a document sheet 5 that is to enter into, or engage, the first feeding roller 41*a*. The contact bar 31 a of the lever 31 is pushed upwardly (or, in other embodiments, moved or pushed downwardly, in view of the direction of travel of the document sheet 5) by the front end of a document sheet 5 that is to enter into, or engage, the first feeding roller 41*a*, and then sensing a time when the contact bar 31*a* of the lever 31 returns to an initial or original position after the rear end of the document sheet 5 is completely out of a contact range of the contact bar 31*a* of the lever 31.

The controller 35 determines or memorizes the time when the contact bar 31*a* of the lever 31 comes in contact with the front end of the document sheet 5 and the time when the rear end of the document sheet 5 is out of the contact range of the contact bar 31*a* of the lever 31. The controller 35 then compares a time difference of the time when the front end of the document sheet 5 contacts the contact bar 31*a* of the lever 31 and the time when the rear end of the document sheet 5 is out of contact range of, or out of contact with, the contact bar 31*a* of the lever 31 with a reference value to provide a comparison result, and the controller 35 determines a double feeding or slipping state of the document sheet based on the comparison result. When double feeding or slipping of the document sheet occurs, the controller 35 outputs a command to change a driving or rotation speed of the second feeding roller 43*a* from a predetermined driving or rotation speed, and when the document sheet 5 is fed without double feeding or slipping, maintains the driving or rotation speed of the second feeding roller 43*a* at the predetermined driving or rotation speed.

In the document feeding method above described, in determining the double feeding or slipping state, the time when the contact bar 31*a* of the lever 31 comes in contact with the front end of the document sheet 5 and the time when the rear end of the document sheet 5 is out of the contact range of the contact bar 31*a* of the lever 31 are determined or memorized by the controller 35; and when a time difference of the time when the contact bar 31 a of the lever 31 comes in contact with the front end of the document sheet 5 and the time when the rear end of the document sheet 5 is out of the contact range of the contact bar 31 a of the lever 31 is equal to a value of length of the document sheet 5 divided by the process rate, the document sheet 5 is fed without being in the double feeding or slipping state, whereas when the time difference of the time when the contact bar 31 a of the lever 31 comes in contact with the front end of the document sheet 5 and the time when the rear end of the document sheet 5 is out of the contact range of the contact bar 31*a* of the lever 31 is different from the value of length of the document sheet 5 divided by the process rate, the document sheet 5 is in the double feeding or slipping state.

Therefore, when double feeding or slippage occurs of the document sheets 5, the rotation speed of the second feeding roller 43*a*, or the rotation speed of both the first and second feeding rollers 43*a*, 43*b*, should be increased for a predetermined amount of time. In this way, document sheets 5 are transported speedily and the interval between document sheets 5 is not too small.

The foregoing embodiments of the present invention are merely exemplary and are not to be construed as limiting the present invention. The teachings can be readily applied to other types of apparatuses and to sheet members, other than document sheets, such as those for sheet feeding or sheet discharging in various sheet transport apparatus, other than an image forming apparatus. Therefore, although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A document discharging apparatus, comprising:

a first delivery roller delivering a document sheet discharged from a fixing unit;

a second delivery roller installed downstream of the first delivery roller and discharging the document sheet to a paper delivery tray;

a motor driving the second delivery roller independently of the first delivery roller;

a lever installed at a side of the first delivery roller out of a document sheet transporting pathway, which rotates at a predetermined angle when in contact with the document sheet and returns to an original position when not in contact with the document sheet;

a sensor sensing a rotation time and a returning time of the lever; and a controller determining a double feeding state of the document sheet based on the sensed rotation time and the sensed returning time of the lever, and controlling the driving speed of the motor to remain constant when the double feeding state is determined and the driving speed of the motor to decrease when the double feeding state is not determined.

2. The apparatus according to claim 1, wherein the lever comprises:

a contact bar selectively contacting the document sheet;

a sensing bar disposed in corresponding relation to the sensor;

a rotation axis member installed at a connecting portion between the contact bar and the sensing bar supporting the rotation of the lever; and an elastic unit returning the lever to the original position when the document sheet is out of contact range of the contact bar.

3. The apparatus according to claim 1, wherein the elastic unit comprises a coil spring.

4. The apparatus according to claim 2, wherein the controller:

determines a document sheet entry time when the front end of the document sheet comes in contact with the contact bar of the lever and a document sheet exit time when the rear end of the document sheet is completely out of the contact range of the contact bar of the lever;

compares a time difference between the document sheet entry time and the document sheet exit time with a value of length of the document sheet divided by a process rate; and controls the second delivery roller to maintain the rotation speed when the time difference is different from the value of length of the document sheet divided by the process rate, whereas the controller outputs a command for reducing the rotation speed of the second delivery roller when the time difference equals to the value of length of the document sheet divided by the process rate.

5. The apparatus according to claim 1, wherein the sensor comprises an optical sensor.

6. The apparatus according to claim 1, wherein the motor comprises a step motor.

7. A document discharging method, comprising:

sensing a time when a lever is pushed by the front end of a document sheet that is to enter into or engage a first delivery roller;

sensing a time when the lever returns to an initial position after the rear end of the document sheet is completely out of a contact range of the lever;

determining the time when the lever comes in contact with the front end of the document sheet and the time when the rear end of the document sheet is out of the contact range of the lever, comparing a time difference of the time when the lever comes in contact with the front end of the document sheet and the time when the rear end of the document sheet is out of the contact range of the lever with a reference value to provide a comparison result, and determining a double feeding state of the document sheet based on the comparison result; and in determining a double feeding state, when the double feeding occurs, rotating a second delivery roller discharging the document sheet to a paper delivery tray at a constant rotation speed, the second delivery roller being installed downstream of the first delivery roller and being driven independently of the first delivery roller, whereas when the document sheet is fed without the occurrence of the double feeding, reducing the rotation speed of the second delivery roller.

8. The method according to claim 7, further comprising restoring the rotation speed of the second delivery roller, when the document sheet is fed without the occurrence of the double feeding.

9. The method according to claim 7, wherein:

in determining the double feeding state, the time when the lever comes in contact with the front end of the document sheet and the time when the rear end of the document sheet is out of the contact range of the lever are determined; and when the time difference of the time when the lever comes in contact with the front end of the document sheet and the time when the rear end of the document sheet is out of the contact range of the lever is equal to a value of the length of the document sheet divided by a process rate, the document sheet is discharged without the occurrence of double feeding, whereas when the time difference of the time when the lever comes in contact with the front end of the document sheet and the time when the rear end of the document sheet is out of the contact range of the lever is different from the value of the length of the document sheet divided by the process rate, the document sheet is in the double feeding state.

10. A sheet member transport apparatus, comprising:

a first roller transporting a sheet member;

a second roller installed downstream of the first roller transporting the sheet member;

a motor driving the second roller independently of the first roller;

a contact sensing member installed at a side of the first roller adjacent to a sheet member transporting pathway, which senses the presence of the sheet member and senses the absence of the sheet member in the sheet member transporting pathway;

a sensor sensing from the contact sensing member an entry time when a front end of the sheet member is sensed by the contact sensing member in the sheet member transporting pathway and an exit time when a rear end of the sheet member is sensed by the contact sensing member in the sheet member transporting pathway; and a controller determining a double feeding state of the sheet member based on the sensed entry time and the sensed exit time to provide a determination result, and the controller outputting to the motor a command for changing a rotation speed of the second roller according to the determination result, wherein the second roller rotates with a first speed when the double feeding state is determined and the second roller rotates with a second speed when the double feeding state is not determined, and wherein the first speed is greater than the second speed.

11. The sheet transport apparatus according to claim 10, wherein the contact sensing member comprised a lever, and the sensor comprises an optical sensor.

12. The sheet transport apparatus according to claim 11, wherein the lever comprises:

a contact bar selectively contacting the sheet member;

a sensing bar disposed in corresponding relation to the sensor;

a rotation axis member installed at a connecting portion between the contact bar and the sensing bar supporting the rotation of the lever; and an elastic unit returning the lever to an initial position when the sheet member is out of contact range of the contact bar.

13. The sheet transport apparatus according to claim 12, wherein the elastic unit comprises a coil spring.

14. The sheet transport apparatus according to claim 13, wherein the motor comprises a step motor.

15. The sheet transport apparatus according to claim 11, wherein the motor comprises a step motor.

16. The sheet transport apparatus according to claim 10, wherein the sheet member comprises a document sheet.

17. The sheet transport apparatus according to claim 16, wherein the contact sensing member comprises a lever, and the sensor comprises an optical sensor.

18. The sheet transport apparatus according to claim 17, wherein the lever comprises:

a contact bar selectively contacting the document sheet;

a sensing bar disposed in corresponding relation to the sensor;

a rotation axis member installed at a connecting portion between the contact bar and the sensing bar supporting the rotation of the lever; and an elastic unit returning the lever to an initial position when the document sheet is out of contact range of the contact bar.

19. The sheet transport apparatus according to claim 18, wherein the elastic unit comprises a coil spring.

20. The sheet transport apparatus according to claim 19, wherein the motor comprises a step motor.

21. The sheet transport apparatus according to claim 17, wherein the motor comprises a step motor.

22. A sheet member transport apparatus, comprising:

a first roller transporting a sheet member;

a second roller installed downstream of the first roller and selectively transporting the sheet member, the second roller being driven independently of the first roller;

a sensor sensing the presence or absence of the sheet member in a sheet member transport pathway; and a controller determining a double feeding state of the sheet member in the sheet member transport pathway based on the sensed presence and the sensed absence of the sheet member to provide a determination result, and the controller selectively changing a rotation speed of the second roller according to the determination result, wherein the second roller rotates with a first speed when the double feeding state is determined and the second roller rotates with a second speed when the double feeding state is not determined, and wherein the first speed is greater than the second speed.

23. The sheet transport apparatus according to claim 22, wherein the controller restores the rotation speed of the second roller, when the sheet member is fed without the occurrence of the double feeding.

24. The sheet transport apparatus according to claim 23, wherein the sheet member comprises a document sheet.

25. The sheet transport apparatus according to claim 22, wherein:

in determining the double feeding state, a time when the sensor senses the front end of the sheet member and the time when the sensor senses the rear end of the sheet member are determined by the controller to provide a time difference between the time when the sensor senses the front end of the sheet member and the time when the sensor senses the rear end of the sheet member; and when the controller determines the time difference is equal to a value of the length of the sheet member divided by a process rate, the sheet member is without the occurrence of double feeding, whereas when the controller determines the time difference is different from the value of the length of the sheet member divided by the process rate, the sheet member is in the double feeding state.

26. The sheet transport apparatus according to claim 25, wherein the sheet member comprises a document sheet.

27. The sheet transport apparatus according to claim 22, wherein the sheet member comprises a document sheet.

28. The sheet transport apparatus according to claim 22, wherein:

in determining the double feeding state, a time when the sensor senses the front end of the sheet member and the time when the sensor senses the rear end of the sheet member are determined by the controller to provide a time difference between the time when the sensor senses the front end of the sheet member and the time when the sensor senses the rear end of the sheet member; and when the controller determines the time difference is equal to a value of the length of the sheet member divided by a process rate, the sheet member is fed without the occurrence of double feeding, whereas when the controller determines the time difference is different from the value of the length of the sheet member divided by the process rate, the sheet member is in the double feeding state.

29. The sheet transport apparatus according to claim 28, wherein the sheet member comprises a document sheet.

30. The sheet transport apparatus according to claim 22, wherein when the double feeding occurs, the controller increases the rotation speed of the second roller for a predetermined amount of time.

31. The sheet transport apparatus according to claim 30, wherein the sheet member comprises a document sheet.

* * * * *